US006956015B2

(12) United States Patent
Kaneko

(10) Patent No.: US 6,956,015 B2
(45) Date of Patent: Oct. 18, 2005

(54) SOLVENT COMPOSITION FOR DISSOLVING PLASTIC

(75) Inventor: Akiyasu Kaneko, Saitama (JP)

(73) Assignee: Kaneko Chemical Co., Ltd., Saitama (JP)

( * ) Notice: Subject to any disclaimer, the term of this patent is extended or adjusted under 35 U.S.C. 154(b) by 1 day.

(21) Appl. No.: 10/663,283

(22) Filed: Sep. 16, 2003

(65) Prior Publication Data

US 2005/0059569 A1 Mar. 17, 2005

(51) Int. Cl.[7] ..... C11D 7/50

(52) U.S. Cl. ..... 510/201; 510/204; 510/212; 510/407; 510/409; 510/410; 510/412; 510/499

(58) Field of Search ..... 510/201, 204, 510/212, 407, 409, 410, 412, 499

(56) References Cited

U.S. PATENT DOCUMENTS 5,492,645 A * 2/1996 Oshima et al. ..... 510/412
5,665,172 A * 9/1997 Oshima et al. ..... 134/40
5,707,954 A * 1/1998 Lee ..... 510/412
6,010,997 A * 1/2000 Thenappan et al. ..... 510/410
6,048,832 A * 4/2000 Thenappan et al. ..... 510/410
6,048,833 A * 4/2000 DeGroot ..... 510/412
6,103,684 A * 8/2000 Thenappan et al. ..... 510/411
6,165,284 A * 12/2000 Shubkin ..... 134/38
6,365,565 B1 * 4/2002 Thenappan et al. ..... 510/411
6,402,857 B2 * 6/2002 Clark et al. ..... 134/31
6,660,701 B1 * 12/2003 Degroot ..... 510/177

FOREIGN PATENT DOCUMENTS

| | | |
|---|---|---|
| JP | 06-220494 | 8/1994 |
| JP | 07-150197 | 6/1995 |
| JP | 08-337795 | 12/1996 |
| JP | 09-302389 | 11/1997 |
| JP | 10-092625 | 4/1998 |
| JP | 11-050097 | 2/1999 |
| JP | 11-172290 | 6/1999 |
| JP | 2001-234193 | 8/2001 |

OTHER PUBLICATIONS

Notice of Reasons for Rejection for Japanese Patent Application No. 2002–146079; mailed Nov. 2, 2004; and English translation thereof.

* cited by examiner

*Primary Examiner*—Lorna M. Douyon
(74) *Attorney, Agent, or Firm*—Harness, Dickey & Pierce, P.L.C.

(57) ABSTRACT

A solvent composition for dissolving plastic comprises at least either isopropyl bromide or n-propyl bromide, and at least either nitromethane or nitroethane. The content of the above-mentioned at least either nitromethane or nitroethane is 5 through 50 wt % with respect to the entire amount of the solvent.

18 Claims, No Drawings

SOLVENT COMPOSITION FOR DISSOLVING PLASTIC

BACKGROUND OF THE INVENTION

1. Field of the Invention

The present invention relates to a solvent composition for dissolving plastic.

2. Description of the Related Art

Fluorine-based and chlorine-based solvent compositions have been widely used as solvent compositions for dissolving plastic. In recent years, however, the influence that fluorine-based solvents and chlorine-based solvents have on the environment has been largely perceived as an environmental problem, and regulations regarding use of such solvents are becoming stricter every year. Under such circumstances, in recent years, solvents that use bromohydrocarbon compounds, such as isopropyl bromide (referred to as "IPB" below) and n-propyl bromide (referred to as "NPB" below), as main ingredients have been proposed as a new type of solvent composition that serve as an alternative to fluorine-based and/or chlorine-based solvent compositions.

For example, Japanese Patent Application Laid-open Publication No. 8-337795 (Japanese Patent Application No. 8-85268) discloses a cleaning solvent that uses 1-bromopropane as a main ingredient and to which nitromethane and the like is added as a stabilizer. Japanese Patent No. 2576933 (Japanese Patent Application Laid-open Publication No. 6-220494) discloses a cleaning solvent that uses IPB or NPB as a main ingredient, but does not include any fluorine-based or chlorine-based solvent, and to which at least one type of compound selected from a group consisting of nitroalkanes and the like is added as a stabilizer.

Further, Japanese Patent Application Laid-open Publication No. 9-302389 (Japanese Patent Application No. 8-121634) discloses a cleaning solvent that uses IPB and/or NPB as a main ingredient and to which nitroalkane and butylene oxide are added as stabilizers.

However, these cleaning solvents that use IPB and/or NPB as a main ingredient do not have the ability to dissolve various kinds of plastics such as polyester resin, acrylic resin, and phenolic resin. For this reason, such cleaning solvents could not be used as an alternative to chlorine-based solvents such as methylene chloride that have been used for dissolving plastics. Therefore, for the purpose of dissolving plastic, chlorine-based solvents such as methylene chloride have to be used within the amount restricted by regulations.

Japanese Patent Application Laid-open Publication No. 11-172290 (Japanese Patent Application No. 9-341644) discloses a solvent having an organic solvent blended to IPB or NPB and having the ability to dissolve plastic. However, since the solvent includes an organic solvent, there exist such problems as that the solvent has slight flammability and that the solvent might cause environmental problems.

Therefore, a solvent for dissolving plastic that uses IPB or NPB, which has slight or no influence on the environment, as a main ingredient, that has a great ability to dissolve various kinds of plastics, and that has no flammability has been long desired.

SUMMARY OF THE INVENTION

The present invention has been made in view of the circumstances described above, and an object thereof is to provide a plastic-dissolving solvent composition that uses IPB or NPB as a main ingredient, that has the ability to dissolve plastic, and that has no flammability.

One aspect of the present invention is a solvent composition for dissolving plastic comprising: at least either isopropyl bromide or n-propyl bromide; and at least either nitromethane or nitroethane, wherein the content of the above-mentioned at least either nitromethane or nitroethane is 5 through 50 wt % with respect to the entire amount of the solvent.

Another aspect of the present invention is a solvent composition for dissolving plastic comprising: at least either isopropyl bromide or n-propyl bromide; and N-methyl pyrrolidone, wherein the content of N-methyl pyrrolidone is 5 through 85 wt % with respect to the entire amount of the solvent.

Features and objects of the present invention other than the above will become clear by reading the description of the present specification with reference to the accompanying drawings.

DETAILED DESCRIPTION OF THE INVENTION

The present inventor has found that the above-mentioned problems can be solved by adding at least either one of nitroethane or nitromethane to IPB and/or NPB and making the content of nitroethane and/or nitromethane be 5 through 50 wt % with respect to the entire amount of the solvent. The present inventor has also found that the above-mentioned problems can be solved by adding N-methyl pyrrolidone to IPB and/or NPB and making the content of N-methyl pyrrolidone be 5 through 85 wt % with respect to the entire amount of the solvent. The present invention has been arrived according to such findings.

The present invention is described in detail below.

The solvent composition for dissolving plastic according to the present invention includes IPB and/or NPB. IPB and NPB have superior features as a solvent in terms that they have low toxicity, they are nonflammable, they are nonaqueous, and that they are recyclable by distillation. NPB has lower toxicity compared to IPB, and therefore, it can be used more preferably. In the solvent composition for dissolving plastic according to the present invention, the content of IPB and/or NPB is generally 50 through 95 wt %, and preferably 60 through 90 wt %, with respect to the entire amount of the solvent. If both IPB and NPB are used, the compositional ratio between IPB and NPB can be set freely.

Nitromethane and nitroethane used in the present invention are preferable because they have low toxicity. Further, nitroethane has been confirmed to have no carcinogenicity, and therefore, nitroethane is used most preferably. Further, nitroethane and nitromethane and NPB and/or IPB become an azeotrope, and therefore, it is possible to easily recycle the solvent by distillation. In the solvent composition of the present invention, the content of nitroethane and/or nitromethane is generally 5 through 50 wt %, preferably 10 through 40 wt %, and more preferably approximately 30 wt %, with respect to the entire amount of the solvent. When the content of nitroethane and/or nitromethane contained in the solvent is within the above-mentioned range, both the ability to dissolve plastic and the ability to clean flux are high and balanced and is thus preferable.

Further, N-methyl pyrrolidone (referred to also as "NMP" below) used in the present invention is preferable in terms that it has superior dissolving ability. In the solvent composition of the present invention, the content of N-methyl pyrrolidone is generally 5 through 85 wt %, and preferably 10 through 85 wt %, with respect to the entire amount of the solvent. When the content of N-methyl pyrrolidone contained in the solvent is within the above-mentioned range, both the ability to dissolve plastic and the ability to clean flux are high and balanced and is thus preferable.

Further, other than the above-mentioned compounds, the solvent composition of the present invention may include a small amount of fluorine-based solvent. By containing a small amount of fluorine-based solvent, it is possible to reduce the surface tension of the solvent and improve permeability of the solvent. Examples of such a fluorine-based solvent include the following: $C_5H_2F_{10}$, $C_4F_9OCH_3$, $C_4F_90C_2H_5$, $(CF_3)_2NCH_2CF_2H$, $(CF_3)_2NCH_2CF_3$, $(CF_3)_2NCH_2CH_3$, $(CF_3)_2NC_3H_7$, $CH_3CCl_2F$, $CH_3CF_2HCl_2$, $CClF_2CF_2CHClF$, $CF_3CF_2CH_2OH$, $CF_3CH_2OH$, and $CF_3CH_2CF_2CH_3$. The content of the fluorine-based solvent is generally 0.1 through 10.0 wt %, and preferably 0.5 through 1.0 wt %, with respect to the entire amount of the solvent. It should be noted that the solvent composition of the present invention does not have to include such a fluorine-based solvent.

The solvent composition of the present invention may include the following additional ingredients: bromine-based solvents other than IPB and NPB; organic solvents such as acetone, dimethylformamide, ethyl acetate, and ethyl lactate; other substances that can be used as solvents; and stabilizers such as phenols, amines, ethers, amilene, esters, organic phosphates, epoxides, furans, alcohols, ketones, and triazoles. Further, the solvent composition for dissolving plastic of the present invention may include any other kinds of substances as long as they do not impair the effect of the present invention.

The solvent for dissolving plastic according to the present invention is prepared by mixing some or all of the ingredients described above, and the method for mixing the ingredients is not limited to a particular method.

Other than for dissolving plastics, the solvent for dissolving plastic of the present invention may be used for cleaning flux, for stripping off or removing plastic films, for coatings, and for adhesives. Plastics that can be dissolved include, but are not limited to, the following: polyester resin, acrylic resin, phenoxy resin, polysulfone resin, styrene resin, epoxy resin, phenolic resin, polycarbonate resin, vinyl acetate resin, polyurethane resin, polyamide resin, polystyrol resin, and cellulose resin. Polyester resin includes, but is not limited to, polyethylene terephthalate, alkyd resin, saturated polyester resin, and unsaturated polyester resin.

The solvent for dissolving plastic according to the present invention can be suitably used as an alternative to methylene chloride.

EXAMPLES

The present invention will be described more specifically according to the following examples.

Working Examples 1–9, Comparative Examples 1–4

As working examples 1–9 and comparative examples 1–4, solvents including NPB and nitroethane having the composition described in Table 1 were prepared. The ability to dissolve resin, the ability to clean flux, and flammability were tested for each of the working examples 1–9 and comparative examples 1–4. The results are shown in Table 1.

It should be noted that, as for the test for the ability to dissolve resin, test specimens having a weight of 5 g and made of the different types of resins shown in Table 1 were each supplied to an Erlenmeyer flask (100 ml) along with 50 g of each of the dissolving agent (working examples 1–9 and comparative examples 1–4) and stirred for 5 hours at 25° C. The dissolution states of each resin were tested. The test results are evaluated in Table 1 according to the following three levels: the resin dissolved completely (VG: very good); the resin dissolved slightly (G: good); and the resin did not dissolve at all (x: poor).

Further, as for the evaluation for the ability to clean flux, an Omegameter, which is generally used for evaluating the cleaning ability of a cleaning liquid, was used. Generally, in an Omegameter, contaminants on, for example, printed wiring boards are dissolved in the solution subjected to measuring, and the electrical conductivity of the solution is measured to evaluate the degree of contamination. With the Omegameter, the degree of contamination of the part before cleaning and the degree of contamination of the part after cleaning were measured, and based on the measurement value, the cleaning ability of each solvent was derived. The results are evaluated in Table 1 in the following three levels according to the amount of time required for cleaning: cleaning was possible in a short amount of time (VG: very good); a long amount of time was required for cleaning (G: good); and cleaning was not possible (x: poor).

Flammability was tested according to the Tag closed cup method.

TABLE 1

| | NPB (wt %) | nitroethane (wt %) | poly-ester | acrylic resin | poly-carbonate | phenoxy resin | poly-sulfone | styrene resin | flux-cleaning ability | flammability |
|---|---|---|---|---|---|---|---|---|---|---|
| comparative example 1 | 100 | 0 | x | x | G | x | x | VG | G | no |
| comparative example 2 | 97 | 3 | x | x | G | x | x | VG | G | no |
| working example 1 | 95 | 5 | G | x | G | G | x | VG | VG | no |
| working example 2 | 90 | 10 | G | G | VG | G | G | VG | VG | no |
| working example 3 | 85 | 15 | G | G | VG | G | G | VG | VG | no |
| working example 4 | 80 | 20 | G | G | VG | G | G | VG | VG | no |

TABLE 1-continued

| | NPB (wt %) | nitroethane (wt %) | poly-ester | acrylic resin | poly-carbonate | phenoxy resin | poly-sulfone | styrene resin | flux-cleaning ability | flammability |
|---|---|---|---|---|---|---|---|---|---|---|
| working example 5 | 75 | 25 | VG | G | VG | VG | G | VG | VG | no |
| working example 6 | 70 | 30 | VG | VG | VG | VG | VG | VG | VG | no |
| working example 7 | 65 | 35 | VG | VG | G | VG | VG | VG | VG | no |
| working example 8 | 60 | 40 | VG | VG | G | VG | VG | VG | G | no |
| working example 9 | 50 | 50 | VG | VG | x | VG | VG | VG | G | no |
| comparative example 3 | 45 | 55 | VG | VG | x | VG | VG | VG | G | yes |
| comparative example 4 | 0 | 100 | x | x | x | x | x | G | G | yes |

VG: very good
G: good
x: poor

As shown in Table 1, it was found that the ability to dissolve resin increases as the content amount of nitroethane is increased. The ability to clean flux was generally good for all tests. However, it was found that if the content amount of nitroethane is too high, the amount of time required for flux cleaning becomes long. Further, it was found that flammability became present when the content amount of nitroethane exceeded 55 wt %.

From these results, it was found that when the content amount of nitroethane is within the range of 5 through 50 wt % with respect to the entire amount of the solvent, it is possible to dissolve plastics such as polyesters and phenoxy resin and the solvent has flux-cleaning ability and is nonflammable, and therefore it is preferable. Further, it was found that when the content amount of nitroethane is within the range of 10 through 40 wt % with respect to the entire amount of the solvent, it is possible to dissolve plastics such as acrylic resin and polysulfone resin, and therefore it is more preferable. Furthermore, it was found that it is possible to clean flux in a short amount of time when the content amount of nitroethane is at most 35 wt % with respect to the entire amount of the solvent.

Working Examples 10–18, Comparative Examples 5–7

Next, tests similar to those for the above-mentioned working examples 1–9 and comparative examples 2–4 were carried out, except that nitromethane was used instead of nitroethane. Solvents having the composition as described in Table 2 were prepared. It should be noted that each test was carried out in the same way as that described above. The test results are shown in Table 2.

TABLE 2

| | NPB (wt %) | nitromethane (wt %) | poly-ester | acrylic resin | poly-carbonate | phenoxy resin | poly-sulfone | styrene resin | flux-cleaning ability | flammability |
|---|---|---|---|---|---|---|---|---|---|---|
| comparative example 5 | 97 | 3 | x | x | G | x | x | VG | G | no |
| working example 10 | 95 | 5 | G | x | G | G | x | VG | VG | no |
| working example 11 | 90 | 10 | G | G | VG | G | G | VG | VG | no |
| working example 12 | 85 | 15 | G | G | VG | G | G | VG | VG | no |
| working example 13 | 80 | 20 | G | G | VG | G | G | VG | VG | no |
| working example 14 | 75 | 25 | VG | G | VG | VG | G | VG | VG | no |
| working example 15 | 70 | 30 | VG | VG | VG | VG | VG | VG | VG | no |
| working example 16 | 65 | 35 | VG | VG | G | VG | VG | VG | VG | no |
| working example 17 | 60 | 40 | VG | VG | G | VG | VG | VG | G | no |
| working example 18 | 50 | 50 | VG | VG | x | VG | VG | VG | G | no |
| comparative example 6 | 45 | 55 | VG | VG | x | VG | VG | VG | G | yes |
| comparative example 7 | 0 | 100 | x | x | x | x | x | G | G | yes |

VG: very good

TABLE 2-continued

| | NPB (wt %) | nitromethane (wt %) | poly-ester | acrylic resin | poly-carbonate | phenoxy resin | poly-sulfone | styrene resin | flux-cleaning ability | flammability |
|---|---|---|---|---|---|---|---|---|---|---|

G: good
x: poor

As shown in Table 2, it was found that results similar to those for when using nitroethane are obtained even when using nitromethane instead of nitroethane.

Working Examples 19–27, Comparative Examples 8–10

Next, tests similar to those for the above-mentioned working examples 1–9 and comparative examples 2–4 were carried out, except that N-methyl pyrrolidone was used instead of nitroethane. Solvents having the composition as described in Table 3 were prepared. It should be noted that each test was carried out in the same way as that described above. The test results are shown in Table 3.

TABLE 3

| | NPB (wt %) | NMP (wt %) | poly-ester | acrylic resin | poly-carbonate | phenoxy resin | poly-sulfone | styrene resin | flux-cleaning ability | flammability |
|---|---|---|---|---|---|---|---|---|---|---|
| comparative example 8 | 97 | 3 | x | x | G | x | x | VG | G | no |
| working example 19 | 95 | 5 | G | x | G | G | x | VG | VG | no |
| working example 20 | 90 | 10 | G | G | VG | G | G | VG | VG | no |
| working example 21 | 85 | 15 | G | G | VG | G | G | VG | VG | no |
| working example 22 | 80 | 20 | G | G | VG | G | G | VG | VG | no |
| working example 23 | 75 | 25 | VG | G | VG | VG | G | VG | VG | no |
| working example 24 | 70 | 30 | VG | VG | VG | VG | VG | VG | VG | no |
| working example 25 | 50 | 50 | VG | VG | VG | VG | VG | VG | VG | no |
| working example 26 | 30 | 70 | VG | VG | VG | VG | VG | VG | VG | no |
| working example 27 | 15 | 85 | VG | VG | VG | VG | VG | VG | VG | no |
| comparative example 9 | 10 | 90 | VG | VG | VG | VG | VG | VG | VG | yes |
| comparative example 10 | 0 | 100 | VG | VG | VG | VG | VG | VG | VG | yes |

VG: very good
G: good
x: poor

As shown in Table 3, similar to the solvents including nitroethane or nitromethane, it was found that the solvents including N-methyl pyrrolidone of working examples 19–27 have the ability sufficient for dissolving various kinds of plastics. Further, it was found that the solvents including N-methyl pyrrolidone are very preferable since their ability to dissolve plastic does not weaken even when the content amount of N-methyl pyrrolidone is 50 wt % or more compared to the solvents including nitroethane or nitromethane.

Working Examples 28–36, Comparative Examples 11–13

Next, tests similar to those for the above-mentioned working examples 1–9 and comparative examples 1–3 were carried out, except that IPB was used instead of NPB. Solvents having the composition as described in Table 4 were prepared. It should be noted that each test was carried out in the same way as that described above. The test results are shown in Table 4.

TABLE 4

| | IPB (wt %) | nitroethane (wt %) | poly-ester | acrylic resin | poly-carbonate | phenoxy resin | poly-sulfone | styrene resin | flux-cleaning ability | flammability |
|---|---|---|---|---|---|---|---|---|---|---|
| comparative example 11 | 100 | 0 | x | x | G | x | x | VG | G | no |
| comparative example 12 | 97 | 3 | x | x | G | x | x | VG | G | no |
| working example 28 | 95 | 5 | G | x | G | G | x | VG | VG | no |

TABLE 4-continued

| | IPB (wt %) | nitroethane (wt %) | poly-ester | acrylic resin | poly-carbonate | phenoxy resin | poly-sulfone | styrene resin | flux-cleaning ability | flammability |
|---|---|---|---|---|---|---|---|---|---|---|
| working example 29 | 90 | 10 | G | G | VG | G | G | VG | VG | no |
| working example 30 | 85 | 15 | G | G | VG | G | G | VG | VG | no |
| working example 31 | 80 | 20 | G | G | VG | G | G | VG | VG | no |
| working example 32 | 75 | 25 | VG | G | VG | VG | G | VG | VG | no |
| working example 33 | 70 | 30 | VG | VG | VG | VG | VG | VG | VG | no |
| working example 34 | 65 | 35 | VG | VG | G | VG | VG | VG | VG | no |
| working example 35 | 60 | 40 | VG | VG | G | VG | VG | VG | G | no |
| working example 36 | 50 | 50 | VG | VG | x | VG | VG | VG | G | no |
| comparative example 13 | 45 | 55 | VG | VG | x | VG | VG | VG | G | yes |

VG: very good
G: good
x: poor

As shown in Table 4, it was found that results similar to those for when using NPB are obtained even when IPB is used instead of NPB as the solvent.

Working Examples 37–45, Comparative Examples 14–15

Next, tests similar to those for the above-mentioned working examples 10–18 and comparative examples 5–6 were carried out, except that IPB was used instead of NPB. Solvents having the composition as described in Table 5 were prepared. It should be noted that each test was carried out in the same way as that described above. The test results are shown in Table 5.

As shown in Table 5, it was found that results similar to those for when using NPB are obtained even when IPB is used instead of NPB as the solvent.

Working Examples 46–54, Comparative Examples 16–17

Next, tests similar to those for the above-mentioned working examples 19–27 and comparative examples 8–10 were carried out, except that IPB was used instead of NPB. Solvents having the composition as described in Table 6 were prepared. It should be noted that each test was carried out in the same way as that described above. The test results are shown in Table 6.

TABLE 5

| | IPB (wt %) | nitromethane (wt %) | poly-ester | acrylic resin | poly-carbonate | phenoxy resin | poly-sulfone | styrene resin | flux-cleaning ability | flammability |
|---|---|---|---|---|---|---|---|---|---|---|
| comparative example 14 | 97 | 3 | x | x | G | x | x | VG | G | no |
| working example 37 | 95 | 5 | G | x | G | G | x | VG | VG | no |
| working example 38 | 90 | 10 | G | G | VG | G | G | VG | VG | no |
| working example 39 | 85 | 15 | G | G | VG | G | G | VG | VG | no |
| working example 40 | 80 | 20 | G | G | VG | G | G | VG | VG | no |
| working example 41 | 75 | 25 | VG | G | VG | VG | G | VG | VG | no |
| working example 42 | 70 | 30 | VG | VG | VG | VG | VG | VG | VG | no |
| working example 43 | 65 | 35 | VG | VG | G | VG | VG | VG | VG | no |
| working example 44 | 60 | 40 | VG | VG | G | VG | VG | VG | VG | no |
| working example 45 | 50 | 50 | VG | VG | x | VG | VG | VG | G | no |
| comparative example 15 | 45 | 55 | VG | VG | x | VG | VG | VG | G | yes |

VG: very good
G: good
x: poor

TABLE 6

| | IPB (wt %) | NMP (wt %) | poly-ester | acrylic resin | poly-carbonate | phenoxy resin | poly-sulfone | styrene resin | flux-cleaning ability | flammability |
|---|---|---|---|---|---|---|---|---|---|---|
| comparative example 16 | 97 | 3 | x | x | G | x | x | VG | G | no |
| working example 46 | 95 | 5 | G | x | G | G | x | VG | VG | no |
| working example 47 | 90 | 10 | G | G | VG | G | G | VG | VG | no |
| working example 48 | 85 | 15 | G | G | VG | G | G | VG | VG | no |
| working example 49 | 80 | 20 | G | G | VG | G | G | VG | VG | no |
| working example 50 | 75 | 25 | VG | G | VG | VG | G | VG | VG | no |
| working example 51 | 70 | 30 | VG | VG | VG | VG | VG | VG | VG | no |
| working example 52 | 50 | 50 | VG | VG | VG | VG | VG | VG | VG | no |
| working example 53 | 30 | 70 | VG | VG | VG | VG | VG | VG | VG | no |
| working example 54 | 15 | 85 | VG | VG | VG | VG | VG | VG | VG | no |
| comparative example 17 | 10 | 90 | VG | VG | VG | VG | VG | VG | VG | yes |

VG: very good
G: good
x: poor

As shown in Table 6, it was found that results similar to those for when using NPB are obtained even when IPB is used instead of NPB as the solvent.

TABLE 7

| | NPB (wt %) | nitroethane (wt %) | nitromethane (wt %) | poly-ester | acrylic resin | poly-carbonate | phenoxy resin | poly-sulfone | poly-styrene | flux-cleaning ability | flammability |
|---|---|---|---|---|---|---|---|---|---|---|---|
| comparative example 18 | 97 | 1.5 | 1.5 | x | x | G | x | x | VG | G | no |
| working example 55 | 95 | 2.5 | 2.5 | G | x | G | G | x | VG | VG | no |
| working example 56 | 90 | 5.0 | 5.0 | G | G | VG | G | G | G | VG | no |
| working example 57 | 85 | 7.5 | 7.5 | G | G | VG | G | G | VG | VG | no |
| working example 58 | 80 | 10.0 | 10.0 | G | G | VG | G | G | VG | VG | no |
| working example 59 | 75 | 12.5 | 12.5 | VG | G | VG | VG | G | VG | VG | no |
| working example 60 | 70 | 15.0 | 15.0 | VG | VG | VG | VG | VG | VG | VG | no |
| working example 61 | 65 | 17.5 | 17.5 | VG | VG | G | VG | VG | VG | VG | no |
| working example 62 | 60 | 20.0 | 20.0 | VG | VG | G | VG | VG | VG | G | no |
| working example 63 | 50 | 25.0 | 25.0 | VG | VG | x | VG | VG | VG | G | no |
| comparative example 19 | 45 | 27.5 | 27.5 | VG | VG | x | VG | VG | VG | G | yes |

VG: very good
G: good
x: poor

Working Examples 55–63, Comparative Examples 18–19

Next, tests similar to those for the above-mentioned working examples 1–9 and comparative examples 2–3 were carried out, except that a "mixture of nitroethane and nitromethane" was used instead of "nitroethane". Solvents having the composition as described in Table 7 were prepared. It should be noted that each test was carried out in the same way as that described above. The test results are shown in Table 7.

As shown in Table 7, it was found that results similar to those for when using nitroethane are obtained even when a "mixture of nitroethane and nitromethane" is used instead of "nitroethane" used in the above-mentioned working examples 1–9 and comparative examples 2–3.

Working Examples 64–72, Comparative Examples 20–21

Next, tests similar to those for the above-mentioned working examples 55–63 and comparative examples 18–19 were carried out, except that IPB was used instead of NPB. Solvents having the composition as described in Table 8 were prepared. It should be noted that each test was carried out in the same way as that described above. The test results are shown in Table 8.

TABLE 8

| | IPB (wt %) | nitroethane (wt %) | nitromethane (wt %) | poly-ester | acrylic resin | poly-carbonate | phenoxy resin | poly-sulfone | poly-styrene | flux-cleaning ability | flammability |
|---|---|---|---|---|---|---|---|---|---|---|---|
| comparative example 20 | 97 | 1.5 | 1.5 | x | x | G | x | x | VG | G | no |
| working example 64 | 95 | 2.5 | 2.5 | G | x | G | G | x | VG | G | no |
| working example 65 | 90 | 5.0 | 5.0 | G | G | VG | G | G | G | VG | no |
| working example 66 | 85 | 7.5 | 7.5 | G | G | VG | G | G | VG | VG | no |
| working example 67 | 80 | 10.0 | 10.0 | G | G | VG | G | G | VG | VG | no |
| working example 68 | 75 | 12.5 | 12.5 | VG | G | VG | VG | G | VG | VG | no |
| working example 69 | 70 | 15.0 | 15.0 | VG | VG | VG | VG | VG | VG | VG | no |
| working example 70 | 65 | 17.5 | 17.5 | VG | VG | G | VG | VG | VG | VG | no |
| working example 71 | 60 | 20.0 | 20.0 | VG | VG | G | VG | VG | VG | G | no |
| working example 72 | 50 | 25.0 | 25.0 | VG | VG | x | VG | VG | VG | G | no |
| comparative example 21 | 45 | 27.5 | 27.5 | VG | VG | x | VG | VG | VG | G | yes |

VG: very good
G: good
x: poor

As shown in Table 8, it was found that results similar to those for the above-mentioned working examples 55–63 using NPB are obtained even when IPB is used instead of NPB.

The solvent composition for dissolving plastic according to the present invention has low toxicity compared to conventional chlorine-based solvents because the present solvent uses IPB or NPB as the main ingredient. Further, since the solvent according to the present invention is nonflammable, it is extremely safe to use and easy to handle. Furthermore, since the solvent according to the present invention has a great ability to dissolve plastics such as resin, it can be suitably used as a solvent for stripping off or removing plastic films, as a solvent for coatings, or as a solvent for adhesives, other than for cleaning.

Although the preferred embodiment of the present invention has been described in detail, it should be understood that various changes, substitutions and alterations can be made therein without departing from spirit and scope of the inventions as defined by the appended claims.

What is claimed is:

1. A solvent composition for dissolving plastic comprising:

60 to 80 wt % of isopropyl bromide and/or n-propyl bromide; and 20 to 40 wt % of nitromethane and/or nitroethane.

2. A solvent composition for dissolving plastic according to claim 1, further including a fluorine-based solvent.

3. A solvent composition for dissolving plastic according to claim 1, further including N-methyl pyrrolidone.

4. A solvent composition for dissolving plastic according to claim 1, wherein the content of said nitromethane and/or nitroethane is 20 through 35 wt % with respect to the entire amount of said solvent.

5. A solvent composition for dissolving plastic according to claim 4, further including N-methyl pyrrolidone.

6. A solvent composition for dissolving plastic according to claim 1, wherein the plastic is selected from the group consisting of: polyester, acrylic resin, polycarbonate, phenoxy resin, polysulfone, styrene resin, and mixtures thereof.

7. A solvent composition for dissolving plastic comprising:

60 to 90 wt % of isopropyl bromide and/or n-propyl bromide; and 10 to 40 wt % nitroethane.

8. A solvent composition for dissolving plastic according to claim 7, further including a fluorine-based solvent.

9. A solvent composition for dissolving plastic according to claim 7, further including N-methyl pyrrolidone.

10. A solvent composition for dissolving plastic according to claim 7, wherein the content of said nitroethane is 10 through 35 wt % with respect to the entire amount of said solvent.

11. A solvent composition for dissolving plastic according to claim 10, further including N-methyl pyrrolidone.

12. A solvent composition for dissolving plastic according to claim 7, wherein the plastic is selected from the group consisting of: polyester, acrylic resin, polycarbonate, phenoxy resin, polysulfone, styrene resin, and mixtures thereof.

13. A solvent composition for dissolving a plastic selected from the group consisting of polyester resin, acrylic resin, phenoxy resin, polysulfone resin, styrene resin, and mixtures thereof, the composition comprising:

50 to 80 wt % of isopropyl bromide and/or n-propyl bromide; and 20 to 50 wt % of nitromethane and/or nitroethane.

14. A solvent composition for dissolving a plastic according to claim 13, further including a fluorine-based solvent.

15. A solvent composition for dissolving a plastic according to claim 13, further including N-methyl pyrrolidone.

16. A solvent composition for dissolving a plastic selected from the group consisting of polyester resin, acrylic resin, phenoxy resin, polysulfone resin, styrene resin, and mixtures thereof, the composition comprising:

50 to 90 wt % of isopropyl bromide and/or n-propyl bromide; and 10 to 50 wt % of nitroethane.

17. A solvent composition for dissolving a plastic according to claim 16, further including a fluorine-based solvent.

18. A solvent composition for dissolving a plastic according to claim 16, further including N-methyl pyrrolidone.

* * * * *